US007127390B1

(12) United States Patent
Su

(10) Patent No.: US 7,127,390 B1
(45) Date of Patent: Oct. 24, 2006

(54) RATE DETERMINATION CODING

(75) Inventor: Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 0 days.

(21) Appl. No.: 09/499,999

(22) Filed: Feb. 8, 2000

(51) Int. Cl.
*G10L 19/00* (2006.01)

(52) U.S. Cl. ..... 704/221

(58) Field of Classification Search ..... 704/220, 704/221, 229, 227
See application file for complete search history.

(56) References Cited

U.S. PATENT DOCUMENTS 5,341,456 A 8/1994 DeJaco
5,742,734 A 4/1998 DeJaco et al.
5,761,634 A * 6/1998 Stewart et al. ..... 704/220
5,778,338 A 7/1998 Jacobs et al.
5,898,696 A 4/1999 Proctor et al.
5,911,128 A * 6/1999 DeJaco ..... 704/200.1
6,006,178 A * 12/1999 Taumi et al. ..... 704/222
6,012,026 A 1/2000 Taori et al.
6,104,993 A * 8/2000 Ashley ..... 704/227
6,400,693 B1 * 6/2002 Otani ..... 370/271

FOREIGN PATENT DOCUMENTS

WO WO 01/22402 A1 3/2001

* cited by examiner

*Primary Examiner*—Angela Armstrong
(74) *Attorney, Agent, or Firm*—Farjami & Farjami LLP

(57) ABSTRACT

A speech encoding system and method for encoding a speech data signal including a number of frames. The speech encoding system includes a speech data rate determinator and a number of speech data signal encoders. The speech data rate determinator determines the data rate of each of the frames and selects one of the speech data signal encoders based on each data rate. Each frame may be encoded using a different encoding method or standard. The encoding system may further include a network controller for selecting any number of the speech data signal encoders based on predetermined factors.

19 Claims, 4 Drawing Sheets

RATE DETERMINATION CODING

BACKGROUND OF THE INVENTION

1. Field of the Invention

The present invention relates in general to signal coding and more particularly, to variable bit rate speech coding.

2. Background

Speech coding is traditionally driven by bandwidth considerations and efficiency. As a result, modern communication systems typically implement various speech coding and compression techniques to reduce requirements on bandwidth and to achieve higher transmission efficiency.

One typical scheme for providing speech coding is a technique called Pulse Code Modulation ("PCM") that is used for converting speech signals into digital form and is widely used by the telephone companies in their T1 circuits. Every minute of the day, millions of telephone conversations, as well as data transmissions via modems, are converted into digital via PCM for transport over high-speed intercity trunks. PCM samples the analog waves 8,000 times per second and converts each sample into an 8-bit number, resulting in a 64 kbps data stream. In fact, the PCM technique has been adopted by the International Telecommunication Union ("ITU") under G.711 standard which defines a single rate coding method at 64 kbps.

Another technique adopted by the ITU utilizes a method called Adaptive Differential PCM ("ADPCM") that converts analog sound, such as speech, into digital. Using this technique, in lieu of coding an absolute measurement at each sample point, the difference between samples is coded. ADPCM can dynamically switch the coding scale to compensate for variations in amplitude. The ITU standards that have utilized this technique include G.721 (32 kbps), G.722 (64 kbps), G.723 (20 kbps and 40 kbps), G.726 (16 kbps, 24 kbps, 32 kbps and 40 kbps) and G.727 (16 kbps, 24 kbps, 32 kbps and 40 kbps).

A more recent ITU standard has adopted the Code Excited Linear Prediction Technique ("CELP") in G.729 family, the main body and Annex A (8 kbps), Annex B (0 kbps and 1.5 kbps), Annex D (6.4 kbps), Annex E (11.2 kbps), and Annex I (0 kbps, 1.5 kbps, 6.4 kbps, 8 kbps and 11.2 kbps) that achieves high compression ratios along with toll quality narrow-band (telephone band) audio. A similar method has also been utilized in G.723.1 (5.3 kbps and 6.4 kbps). And a method called Low-Delay CELP ("LD-CELP") has been used in G.728 (16 kbps) standards and provides near toll quality audio by using a smaller sample size that is processed faster, resulting in lower delays.

As noted above, G.723, G.726, G.727, G.729 Annex I and G.723.1 standards define a multi-rate capability for speech data transfer. Today, these multi-rates have been taken advantage of by the network providers, such as AT&T, MCI or Sprint, which control data bit rates according to predetermined factors, such as time of the day or particular usage of the network. For example, the network providers may decide to save network bandwidth during business hours and limit the data bit rate to 6.4 kbps. After business hours, however, the network providers may increase the data bit rate to 11.2 kbps. Yet, the network providers may allocate certain lines for high quality speech data transfer during specific hours.

FIG. 1 illustrates a typical system 100 used by the network providers for implementing the above schemes. As shown, system 100 includes a plurality of speech encoders 1,2, . . . , n, enumerated as modules 130, 140, . . . , 150, respectively. In one embodiment, system 100 may be ITU G.729 Annex I compatible and speech encoder 130 may encode at 6.4 kbps, speech encoder 140 may encode at 8.0 kbps and speech encoder 150 may encode at 11.2 kbps.

As shown in FIG. 1, encoder selector 112 is positioned by the network controller 120. As stated above, the selector 112 is positioned in accordance with predetermined factors under the network provider control. For example, the network controller 120 may decide to use the speech encoder 150 at data bit rate of 11.2 kbps after business hours or from 2:00 p.m. to 4:00 p.m. when communication channel 160 is utilized for music broadcast which requires high data rates to preserve the speech quality. On the other hand, the network controller 120 may position the encoder selector 112 so as to select the speech encoder 130 at data bit rate of 6.4 kbps for voice communications from 4:00 p.m. to 8:00 p.m.

While such traditional multi-rate speech encoders have been successfully implemented in digital communication systems, they are restricted in use and application. Such systems are disadvantageous and inflexible, since data bit rates are set based on predetermined factors that may or may not hold true. As a result, too little or too much of the network bandwidth may be used for a given speech. For example, high quality speech, such as music, may be transmitted on a communication channel selected to transmit at low date rates, and thus, causing degradation in the quality. On the other hand, a high data rate communication channel may be wasted if only low quality speech, such as voice which does not require a high bandwidth, is transmitted.

Accordingly, there is an intense need in the technology for a flexible speech encoder that can efficiently utilize the bandwidth of a given communication channel. Furthermore, there is a strong need in the industry for a speech encoder system that can combine various speech encoding schemes while maintaining interoperability with the exiting speech decoders and standards.

SUMMARY OF THE INVENTION

In accordance with the purpose of the present invention as broadly described herein, there is provided method and system for rate determination coding.

In one embodiment, the present invention includes a data rate determinator and a plurality of data signal encoders. The data rate determinator determines the data rate for the data signal and selects one of the data signal encoders based on the determined data rate and encodes the data signal accordingly.

In another embodiment, the system includes a plurality of speech encoders, a network controller capable of selecting at least two of the speech encoders and a data rate determinator capable of determining the data rate of the speech signal and selecting, according to the data rate, one of the speech encoders selected by the network controller.

In one aspect of the present invention, the data or speech signal includes a number of frames and the data rate determinator determines the data rate of each of the frames and selects one of the encoders based on the data rate of each frame. The signal is then encoded frame-by-frame. In another aspect of the present invention, different encoding standards may be utilized for encoding various frames of the signal.

Other aspects of the present invention will become apparent with further reference to the drawings and specification, which follow.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
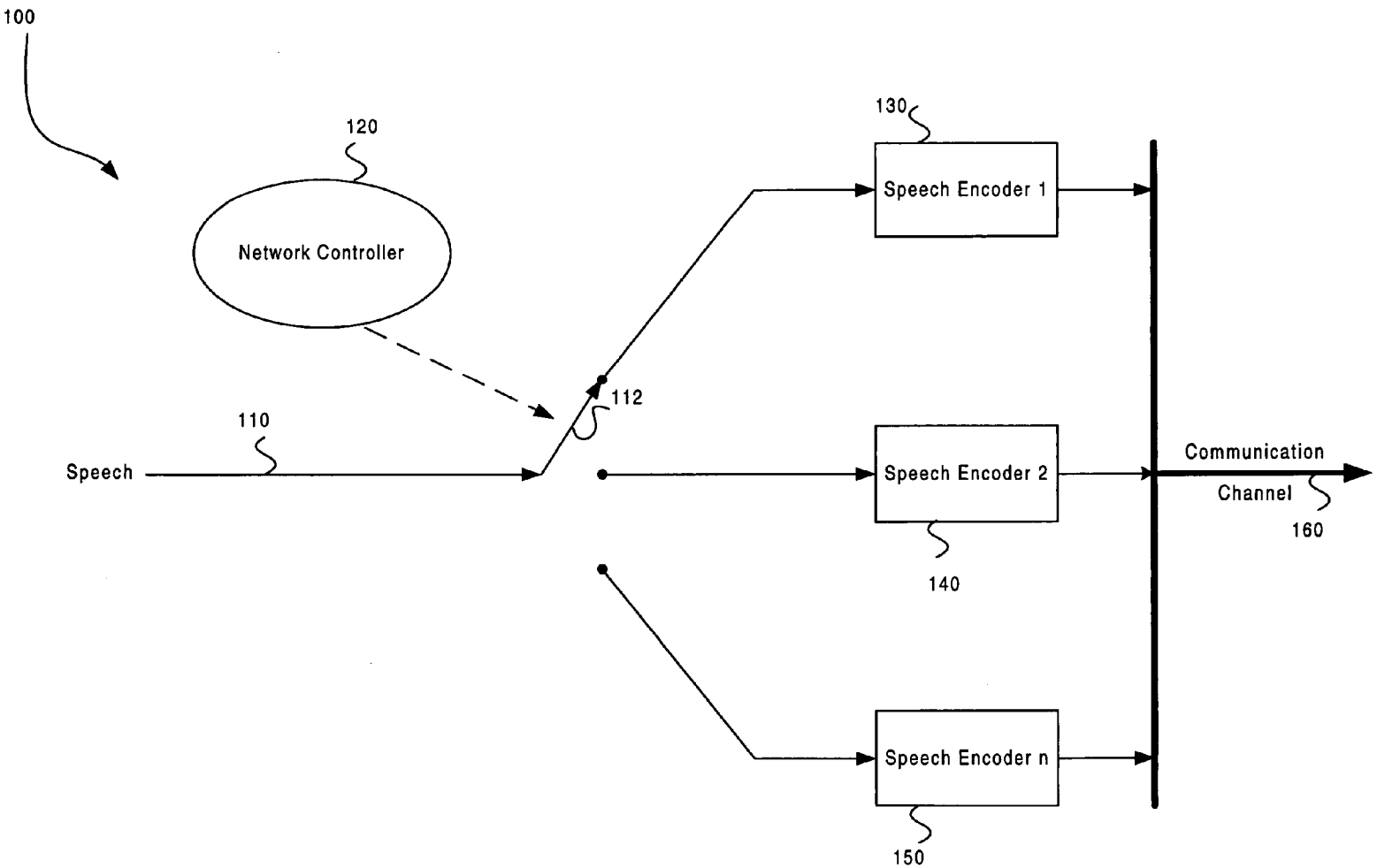
Figure 1 (Prior Art)
FIG. 1 illustrates a conventional speech encoding system.
Figure 2:
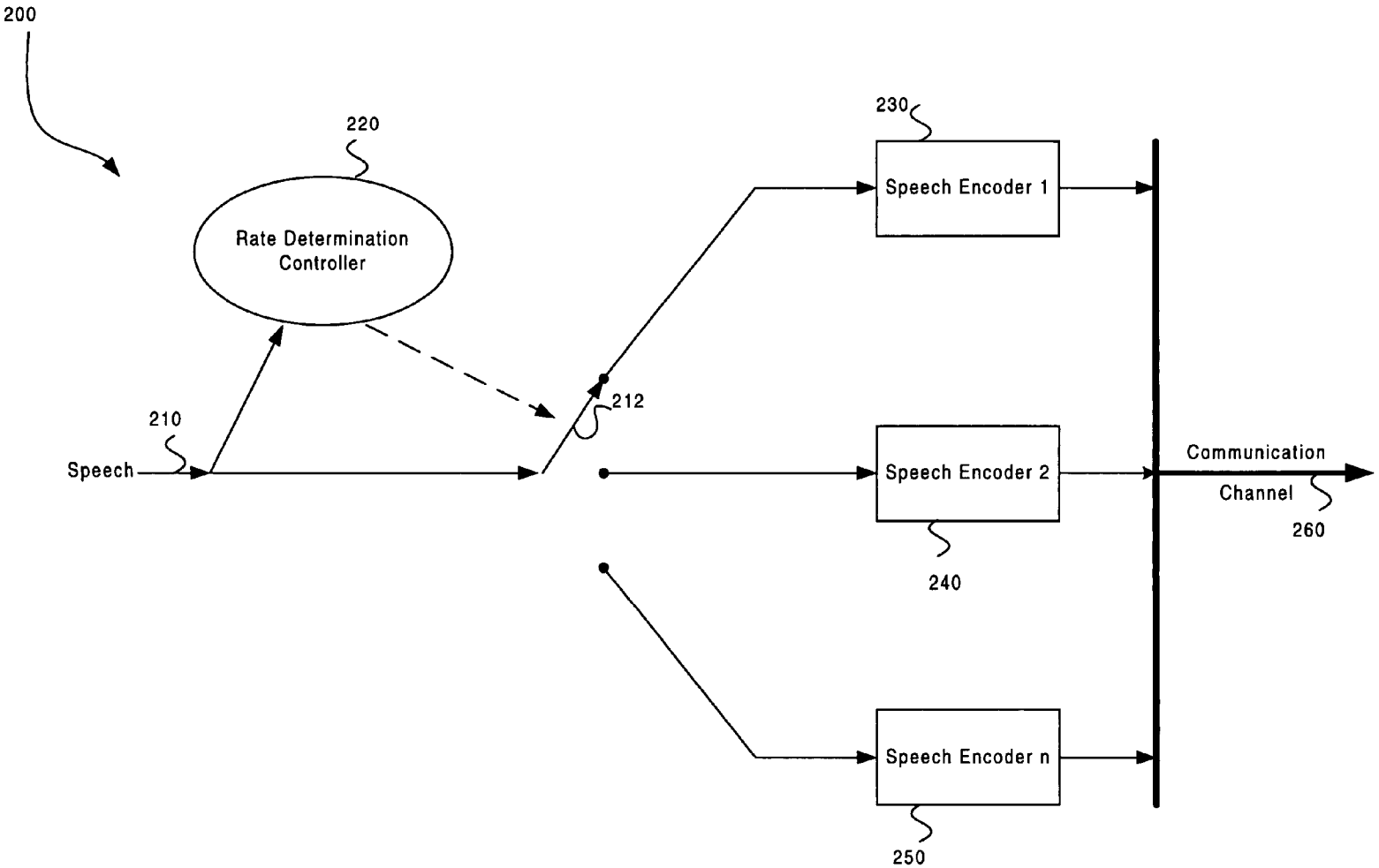
FIG. 2 illustrates one embodiment of a speech encoding system of the present invention.

An embodiment of the present invention is shown in FIG. 2. As shown, speech encoding system 200 includes speech encoders 1 . . . n. In one embodiment, the speech encoders 1 . . . n may support a subset or a complete set of speech coding data rates of a single standard. In this particular example, however, the speech encoders (1 . . . 3) 230, 240 and 250, respectively, may support data bit rates of 6.4, 8.0 and 11.2 kbps of the G.729 Annex I standard, respectively. In another embodiment, speech encoding system 200 may include five speech encoders for supporting all data bit rates defined under G.729 Annex I standard. In yet another embodiment, each speech encoder may support a different standard. For example, the speech encoder 230 may support the G.721 ADPCM standard at 32 kbps, the speech encoder 240 may support the G.723.1 standard at 5.3 kbps and the speech encoder 250 may support the G.729 Annex I standard at 11.2 kbps.

As shown, speech signal 210 enters the encoding system 200 for transmission over communication channel 260. A "communication channel" refers to the medium or channel of communication. The communication channel may include, but is not limited to, a telephone line, a modem connection, an Internet connection, an Integrated Services Digital Network ("ISDN") connection, an Asynchronous Transfer Mode (ATM) connection, a frame relay connection, an Ethernet connection, a coaxial connection, a fiber optic connection, satellite connections (e.g. Digital Satellite Services, etc.), wireless connections, radio frequency (RF) links, electromagnetic links, two way paging connections, etc., and combinations thereof.

In accordance with the practices of persons skilled in the art of computer programming, the present invention is described below with reference to symbolic representations of operations that are performed by the system 200 (FIG. 2) and/or the system 400 (FIG. 4), unless indicated otherwise. Such operations are sometimes referred to as being computer-executed. It will be appreciated that operations that are symbolically represented include the manipulation by a processor of electrical signals representing data bits and the maintenance of data bits at memory locations in system memory (not shown), as well as other processing of signals. The memory locations where data bits are maintained are physical locations that have particular electrical, magnetic, optical, or organic properties corresponding to the data bits.

When implemented in software, the elements of the present invention are essentially the code segments to perform the necessary tasks. The program or code segments can be stored in a processor readable medium or transmitted by a data signal embodied in a carrier wave over a transmission medium or communication link. The "processor readable medium" may include any medium that can store or transfer information. Examples of the processor readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

Returning to FIG. 2, the speech signal 210 is routed to a rate determination controller module 220 for analyzing the speech signal on frame-by-frame basis. Each frame of speech is analyzed by the rate determination controller 220 in order to select one of the speech encoders 230–250, for the most efficient use of the communication channel 260. As understood by those of ordinary skill in the art, for example, frames of speech are sampled at 10 ms intervals or blocks under the G.729 standard. An analysis of each 10 ms frame of speech, using well-known methods, the rate determination controller 220 may select one of the plurality of speech encoders 230, 240 and 250.

For example, if the speech signal has the shape or characteristics of a male voice, the rate determination controller 220 may position the encoder selector 212 to select a medium data rate speech encoder, such as the speech encoder 230, G.729 6.4 kbps, to encode that particular frame. For the next frame, however, if the rate determination controller 220 finds a higher quality speech frame, such as music-like speech, the rate determination controller 220 may position the encoder selector 212 to select a high data rate encoder, such as the speech encoder 250, G.729 11.2 kbps, to encode that speech frame in order to prevent quality degradation. In one embodiment, the speech encoder 250 of the system 200 may be a G.727 ADPCM 24.0 kbps, in that event, positioning the encoder selector 212 to the speech encoder 250 by the rate determination controller 220 would cause the speech frame be encoded using the G.727 standard.

It should be noted that according to one embodiment of the present invention, various numbers of speech encoders of different standards may be included in the speech encoding system 200. Such embodiment, of course, requires a complementary speech decoding system that can support these various speech encoders in order to decode the speech on a frame-by-frame basis.

However, in some embodiments, the speech encoding system 200 may encode the speech frames using various speech encoders belonging to a single standard, such as G.729 Annex I. Such systems are advantageous since they require no change to the conventional decoding systems.

The rate determination controller 220 may be implemented as hardware, firmware or software, or any combination thereof. The resulting bit stream from each of the speech encoder 230, 240 and 250 is provided to a communication channel 260.

As described above, speech signal 210 is first routed to the rate determination controller 220 on a frame-by-frame basis. Once the speech signal 210 is routed to the rate determination controller 220, a predetermined flag in the header of the speech frame is analyzed to determine classification of the speech frame. For example, the value of the flag in the speech frame may indicate that the speech frame is a non-active speech signal (background noise or silence) and thus is to be processed by a low bit rate encoder. The value of the flag in the speech frame may indicate that the speech frame is an active speech and of high quality, such as music, and is thus to be processed using a high bit rate encoder. In the alternative, the value of the flag in the speech frame may indicate that the speech frame is an active speech but of medium quality, such as male voice, and is thus to be processed using a medium bit rate encoder. Once the encoding scheme is determined, the speech frame is routed to one of the speech encoders 1 . . . n via the encoder selector 212. It is understood that classification of the input speech may be accomplished by any type of control circuit or software, based on a predetermined standard, criterion or set of criteria, or based on system requirements and/or need.

Figure 3:
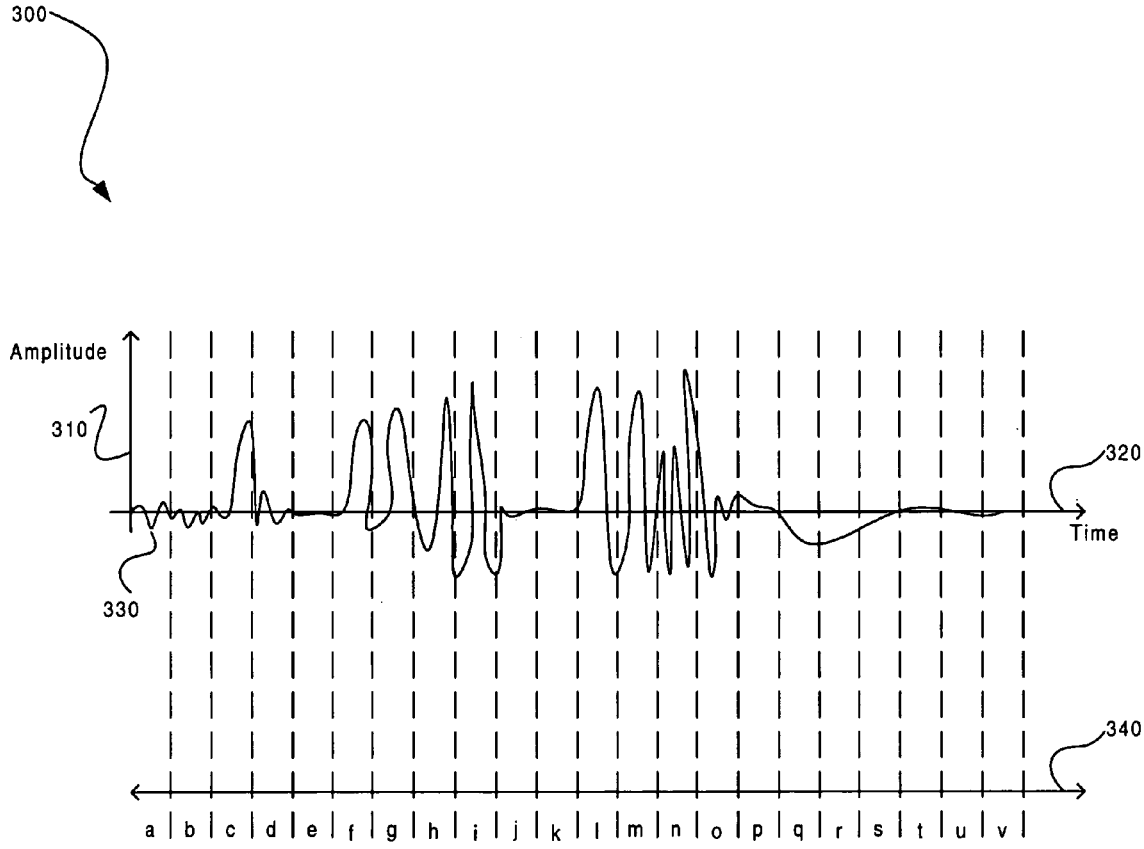
FIG. 3 illustrates an example input signal of FIG. 2.

Turning to FIG. 3, a speech signal diagram 300 is shown. FIG. 3 illustrates a speech signal 330 mapped into amplitude 310/time 320 axis. The speech signal 330 is broken down into blocks of time as denoted by vertical dotted lines. Each block of time a–v, on the time line 340, represents one frame of speech. As stated above, one frame of speech is, for example, 10 ms in duration per G.729 ITU standard, or in some embodiments, frames are in 5 ms intervals. Referring back to FIG. 2 and assuming the speech encoders 230, 240 and 250 are G.729 1.5 kbps, G.729 8.0 kbps and G.726 32.0 kbps, respectively, when the speech frame (a) of speech signal 330 enters the encoding system of 200, the rate determination controller 220 first determines the type speech in speech frame (a) based on well-known methods known to those of ordinary skill in the art. As shown, speech frame (a) is low quality speech or background noise and thus the rate determination controller 220 may position the encoder selector 212 to select a low data rate speech encoder, such as the speech encoder 230 at 1.5 kbps, to encode speech frame (a). As for the next speech frame (b), the rate determination controller 220 may retain the same position for the encoder selector 212. However, for the speech frames (c) and (f), the rate determination controller 220 may select a medium data rate, such as the speech encoder 240 at 8.0 kbps. As for speech frames (h), (i), (l) and (m), the rate determination controller 220 may select a high data rate speech encoder, such as the speech encoder 250 at 32.0 kbps, to preserve the quality of speech.

Figure 4:
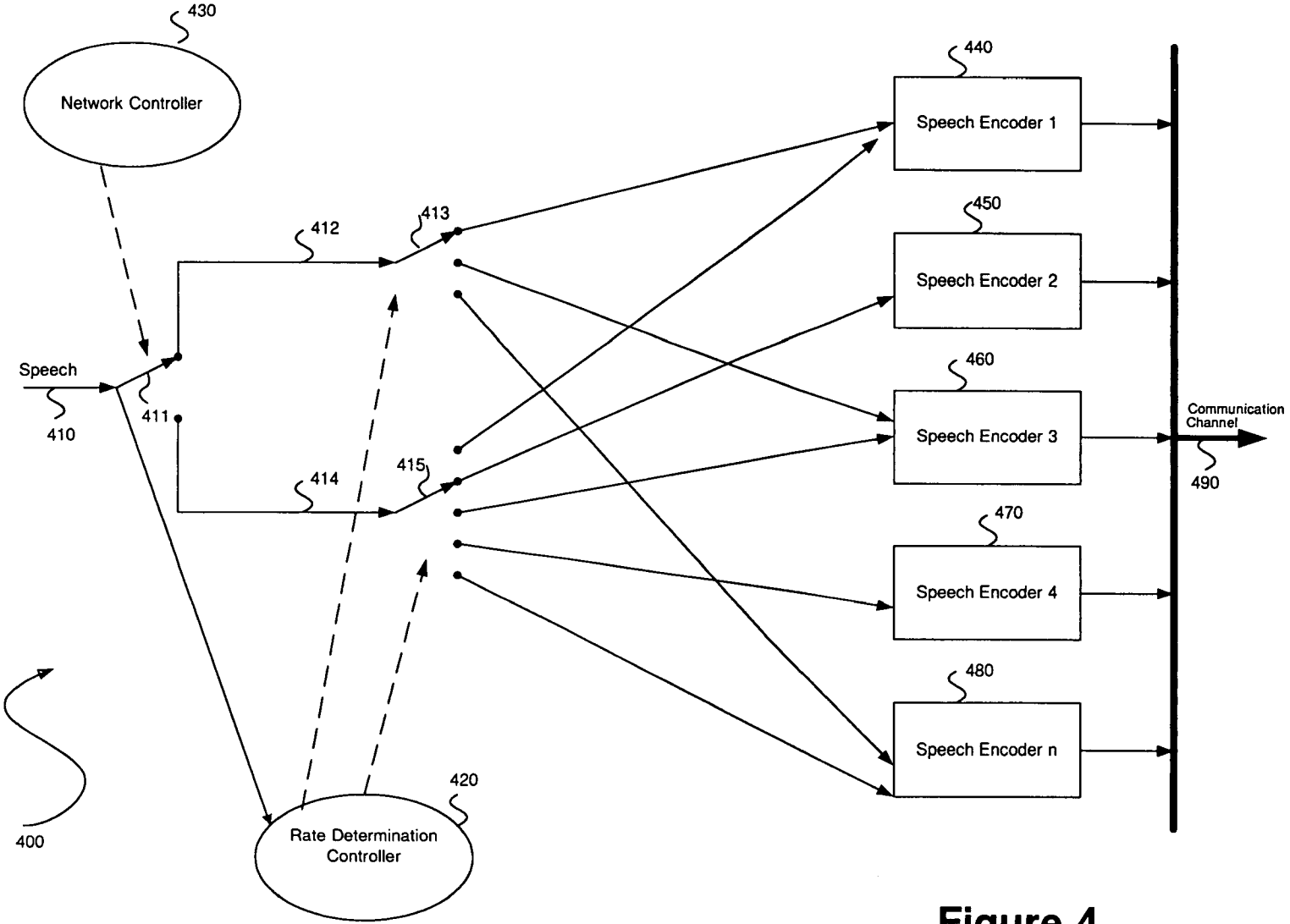
FIG. 4 illustrates another embodiment of a speech encoding system of the present invention.

FIG. 4 illustrates another embodiment of the present invention. As shown, the speech encoding system 400 includes a network controller 430, a rate determination controller 420 and a plurality of speech encoders 1 . . . n, denoted 440, 450, 460, 470 and 480, respectively, for transmitting speech signal 410 over a communication channel 490. According to this embodiment, the network controller 430 may select one of a plurality of groups of speech encoders for encoding the speech signal 410. The network controller 430 may route the speech signal 410 either through line 412 or 414 according to predetermined factors of the network provider. As shown, line 412 routes the speech signal 410 to a first group of encoders, including speech encoders 440, 460 and 480. Line 414, on the other hand, routes the speech signal 410 to a second group of speech encoders, including speech encoders, 440, 450, 460, 470 and 480. In one embodiment, the speech encoders 440, 450, 460, 470 and 480 may support different data rates of G.729 Annex I, 0, 1.5, 6.0, 8.0 and 11.2 kbps, respectively. In another embodiment, the speech encoder 440 may support 0 kbps data rate of the G.729 Annex I standard, the speech encoder 450 may support 5.3 kbps of the G.723.1 standard, the speech encoder 460 may support 8.0 kbps data rate of the G.729 Annex I standard, the speech encoder 470 may support 16.0 kbps data rate of the G.728 standard and the speech encoder 480 may support 64.0 kbps data rate of the G.711 standard. In short, various data rates of different standards may be combined and supported accordingly.

Just as explained above in relation to the embodiment of FIG. 2, the rate determination controller 420 may route each frame of the speech signal 410 using encoder selectors 413 and 415 to one of plurality of the speech encoders according to characteristics of each speech frame. However; the network controller 430 may designate a specific group of speech encoders that may be utilized by the rate determination controller 420. For example, during certain hours of the day, the network controller 430 may route the speech signal through the line 412 to the encoder selector 413 which provides less number of speech encoders to choose from for use by the rate determination controller 420.

The present invention thus provides an apparatus and method for providing flexible variable bit rate encoding. The flexible encoding scheme facilitates encoding of speech using any desired standard, criteria or fixed rate-bit encoders. In one embodiment, the speech encoders 440–480 may be existing fixed bit-rate encoders, such as GSM EFR (enhanced Full-Rate), IS-641 (TIA/EIA TDMA standard), etc., or in yet other embodiments, the speech encoders 440–480 may include single multi-rate standards, such as GSM AMR (adaptive multi-rate), or any combinations of the above.

At any given time interval, speech may be encoded using one or a plurality of standards and/or criteria. The encoding system of the invention may interface with a decoding system based on existing standards. Alternatively, it may interface with a decoding system implemented using new standards or a decoding system with a combination of existing and new standards. In this manner, the invention provides flexibility in choice of standards, bandwidth requirements or quality of service, while enabling use with existing systems and/or new systems. Existing decoding systems may interface with the encoding system of the invention without any change or alteration. At the same time, the encoding system may accommodate the use of new standards while providing flexibility of choice.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A method of enhancing an installed speech coding system that has been in use for encoding a speech signal including a plurality of speech signal frames, said installed speech coding system including a plurality of installed speech encoders, said method comprising the steps of:

providing a rate determinator module;

connecting said rate determinator module to said installed speech coding system;

receiving said plurality of speech signal frames by said rate determinator;

determining a data rate of one of said speech signal frames by said rate determinator;

selecting one of said installed plurality of speech encoders according to said data rate on a frame-by-frame basis, said installed plurality of speech encoders including at least a first encoder using a first speech encoding scheme and a second encoder using a second speech encoding scheme, wherein said second speech encoding scheme belongs to a different speech coding standard than said first speech encoding scheme; and encoding said one of said speech signal frames using said one of said plurality of speech encoders on the frame-by-frame basis;

wherein said determining, selecting and encoding steps are repeated so as to encode said speech signal on the frame-by-frame basis.

2. The method of claim 1, wherein each of said frames contains about 10 ms of speech signal.

3. The method of claim 1, wherein said data signal includes a first frame and a second frame, and wherein said first frame is encoded using said first encoder and said second frame is encoded using said second encoder.

4. The method of claim 1, wherein said data signal is a single frame of an active speech signal.

5. The method of claim 1, wherein said plurality of said speech encoders include G.729 ITU compliant speech encoders of 0, 1.5, 6.4, 8.0 and 11.2 kbps data rates.

6. The method of claim 1, wherein said plurality of said speech encoders include G.729 ITU compliant speech encoders of 0, 8.0 and 11.2 kbps data rates and G.726 ITU compliant speech encoders of 24.0 and 40.0 kbps data rates.

7. The method of claim 1, wherein said first speech encoder is based on G.729 at 11.2 kbps and said second speech encoder is based on G.723.1 at 6.4 kbps.

8. The method of claim 1, wherein said determining said date rate is based on a speech classification of said frame.

9. The method of claim 1, wherein said first encoder is a fixed bit-rate encoder incapable of rate determination.

10. The method of claim 1, wherein said first encoder is a G.721 ITU compliant speech encoder and said second encoder is a G.723.1 ITU compliant speech encoder.

11. A method of enhancing an installed speech coding system that has been in use for encoding a speech signal including a plurality of speech signal frames, said installed speech coding system including a plurality of installed speech encoders, said method comprising the steps of:

providing a rate determinator module;

connecting said rate determinator module to said installed speech coding system;

receiving said plurality of speech signal frames by said rate determinator;

choosing, according to a predetermined factor, one group from a plurality of groups of installed speech encoders, said chosen group of installed speech encoders including at least a first encoder using a first speech encoding scheme and a second encoder using a second speech encoding scheme, wherein said second speech encoding scheme belongs to a different speech coding standard than said first speech encoding scheme;

determining a data rate of one of said speech signal frames;

selecting, according to said data rate, one of said plurality of installed speech encoders in said chosen group on a frame-by-frame basis; and encoding said one of said speech signal frames using said selected speech encoder on the frame-by-frame basis;

wherein said determining, selecting and encoding steps are repeated so as to encode said speech signal on the frame-by-frame basis.

12. The method of claim 11, wherein said plurality of said speech encoders include G.729 ITU compliant speech encoders of 0, 1.5, 6.4, 8.0 and 11.2 kbps data rates.

13. The method of claim 11, wherein said plurality of said speech encoders include G.729 ITU compliant speech encoders of 0, 8.0 and 11.2 kbps data rates and G.723.1 ITU compliant speech encoders of 5.3 and 6.4 kbps data rates.

14. The method of claim 11, wherein said network controller is capable of selecting two or more speech encoder groups, wherein each of said groups includes at least one of said speech encoders and one of said groups includes at least two of said speech encoders.

15. The method of claim 14, wherein said speech encoder groups are mutually exclusive.

16. The method of claim 14, wherein one of said groups includes G.729 ITU compliant speech encoders of 0, 1.5, 8.0 kbps and another one of said groups includes G.721 compliant speech encoder of 32 kbps.

17. The method of claim 11, wherein said determining said date rate is based on a speech classification of said frame.

18. The method of claim 11, wherein said first encoder is a fixed bit-rate encoder incapable of rate determination.

19. The method of claim 11, wherein said first encoder is a G.721 ITU compliant speech encoder and said second encoder is a G.723.1 ITU compliant speech encoder.

* * * * *